US008567569B2

(12) United States Patent
Suzuki et al.

(10) Patent No.: US 8,567,569 B2
(45) Date of Patent: Oct. 29, 2013

(54) ELEVATOR GROUP MANAGEMENT SYSTEM

(75) Inventors: Naohiko Suzuki, Tokyo (JP); Masafumi Iwata, Tokyo (JP); Shingo Kobori, Tokyo (JP); Sakurako Tokura, Tokyo (JP); Yoshimasa Koba, Tokyo (JP); Kouji Takeshima, Aichi (JP); Masayuki Mitsuda, Aichi (JP); Yoshinori Nonami, Aichi (JP)

(73) Assignee: Mitsubishi Electric Corporation, Tokyo (JP)

( * ) Notice: Subject to any disclaimer, the term of this patent is extended or adjusted under 35 U.S.C. 154(b) by 448 days.

(21) Appl. No.: 13/062,235

(22) PCT Filed: Sep. 3, 2009

(86) PCT No.: PCT/JP2009/065399
§ 371 (c)(1),
(2), (4) Date: Mar. 4, 2011

(87) PCT Pub. No.: WO2010/032623
PCT Pub. Date: Mar. 25, 2010

(65) Prior Publication Data

US 2011/0155515 A1 Jun. 30, 2011

(30) Foreign Application Priority Data

Sep. 19, 2008 (JP) ..... 2008-240105

(51) Int. Cl.
*B66B 1/18* (2006.01)

(52) U.S. Cl.
USPC ..... 187/382; 187/247; 187/391

(58) Field of Classification Search
USPC ..... 187/247, 380–389, 391–393, 395, 396
See application file for complete search history.

(56) References Cited

U.S. PATENT DOCUMENTS 5,865,274 A * 2/1999 Kiji et al. ..... 187/380
6,360,849 B1 3/2002 Hikita (Continued)

FOREIGN PATENT DOCUMENTS

CN 101039861 A 9/2007
DE 2411861 9/1974

(Continued)

OTHER PUBLICATIONS

Office Action issued Aug. 21, 2012 in Korean Patent Application No. 10-2011-7006162 (The partial English translation is made on the basis of a Japanese translation of the Office Action. Submitting Japanese translation also).

(Continued)

*Primary Examiner* — Anthony Salata
(74) *Attorney, Agent, or Firm* — Oblon, Spivak, McClelland, Maier & Neustadt, L.L.P.

(57) ABSTRACT

An elevator group management system improving operational efficiency in consideration of a situation change that has occurred after a destination floor registration in a hall. An assigned car review mechanism executes assigned car review processing in units of review registration information sets each including at least one piece of provisionally assigned car registration information managed by a registered destination floor hall call management section during a review period. After ending the assigned car review processing, the assigned car review mechanism modifies the contents of the provisionally assigned car registration information in the registered destination floor hall call management section based on the contents of the review registration information set after modification. That is, the assigned car review mechanism newly registers the provisionally assigned car registration information after review and erases the provisionally assigned car registration information before review at the same time.

11 Claims, 8 Drawing Sheets

(56) References Cited

U.S. PATENT DOCUMENTS

| | | | | |
|---|---|---|---|---|
| 7,014,015 | B2 * | 3/2006 | Nikovski et al. | 187/382 |
| 7,021,429 | B2 | 4/2006 | Hikita | |
| 7,389,857 | B2 | 6/2008 | Hikita | |
| 7,392,884 | B2 * | 7/2008 | Hikita | 187/249 |
| 7,975,808 | B2 * | 7/2011 | Smith et al. | 187/382 |
| 8,104,585 | B2 * | 1/2012 | Smith et al. | 187/382 |
| 8,151,943 | B2 * | 4/2012 | de Groot | 187/382 |
| 8,276,715 | B2 * | 10/2012 | Smith et al. | 187/382 |
| 8,286,755 | B2 * | 10/2012 | Eto et al. | 187/381 |
| 8,397,874 | B2 * | 3/2013 | de Groot | 187/382 |
| 2005/0098391 | A1 | 5/2005 | Rintala et al. | |
| 2008/0289910 | A1 | 11/2008 | Christy et al. | |
| 2011/0198160 | A1 * | 8/2011 | Suzuki et al. | 187/382 |

FOREIGN PATENT DOCUMENTS

| | | | |
|---|---|---|---|
| EP | 1 565 396 | B1 | 8/2005 |
| EP | 1 873 106 | A1 | 1/2008 |
| EP | 1 880 965 | A1 | 1/2008 |
| JP | 54 014382 | | 6/1979 |
| JP | 3 272979 | | 12/1991 |
| JP | 4-169484 | A | 6/1992 |
| JP | 06 183652 | | 7/1994 |
| JP | 2000 272850 | | 10/2000 |
| JP | 2001 48431 | | 2/2001 |
| JP | 2003 012249 | | 1/2003 |
| JP | 2004-250191 | | 9/2004 |
| JP | 2005-523222 | A | 8/2005 |
| JP | 2008 150208 | | 7/2008 |
| KR | 10-2006-0088881 | | 8/2006 |
| WO | 03 000579 | | 1/2003 |
| WO | WO 2005/044708 | A1 | 5/2005 |
| WO | 2005 092762 | | 10/2005 |
| WO | 2006 114877 | | 11/2006 |
| WO | 2007 070054 | | 6/2007 |
| WO | 2009 123014 | | 10/2009 |

OTHER PUBLICATIONS

Office Action issued Feb. 19, 2013 in Japanese Patent Application No. 2010-529714 with English language translation.

Combined Office Action and Search Report issued Mar. 15, 2013 in Chinese Patent Application No. 200980136445.X with English language translation.

U.S. Appl. No. 13/395,909, filed Mar. 14, 2012, Koba.

U.S. Appl. No. 13/496,048, filed Mar. 14, 2012, Koba, et al.

Office Action issued May 15, 2012 in German Application No. 11 2009 002 239.1 (With English Translation).

Office Action issued Jun. 4, 2013 in Japanese Patent Application No. 2010-529714 with partial English language translation.

U.S. Appl. No. 13/510,326, filed May 17, 2012, Mitsuda, et al.

International Search Report issued Nov. 24, 2009 in PCT/JP09/065399 filed Sep. 3, 2009.

* cited by examiner

ELEVATOR GROUP MANAGEMENT SYSTEM

TECHNICAL FIELD

The present invention relates to an elevator group management system that receives destination floor calls with a hall destination floor registration device installed in a hall or hall floor and notifies assigned cars according to a destination floor.

BACKGROUND ART

In conventional elevator group management systems using hall destination floor registration devices, assigned cars are determined immediately after destination floors are registered in a hall and assigned cars are notified according to a destination floor. For example, Patent Document 1 discloses the elevator group management system as the above-mentioned elevator group management system.

The provisional assignment described in Patent Document 2 (FIG. 3) is as follows. In an elevator system in which two cars capable of going up and down independently of each other travel in one shaft, a new destination call is provisionally assigned to one car by car travel range calculation means, and then a travel range of the other car in the same shaft is calculated. After that, assigned car candidates for the new destination call are selected based on the calculated car travel range, and then various evaluation index values are calculated for the respective assigned car candidates. Then, the calculated various evaluation index values are judged comprehensively, to thereby determine the car to which the new destination call is assigned. That is, the provisional assignment of Patent Document 2 is performed for selection of assigned car candidates in assigned car determining computation and evaluation value computation.

Further, as described particularly in Patent Document 3 (FIG. 3), the provisional assignment described in Patent Document 3, Patent Document 4 and the like, is performed for, when an assigned car is determined immediately upon call registration being made, provisionally determining an assigned car and computing an evaluation function, to thereby select the assigned car that is provisionally determined when the evaluation function takes the most suitable value as an assigned car, where the assigned car is indicated to passengers immediately after the assigned car is determined. That is, the provisional assignment disclosed in Patent Document 3 and Patent Document 4 is performed for evaluation value computation in assigned car determining computation.

Further, the assignment change disclosed in Patent Document 5 refers to an assignment change made in a case where an assigned car becomes full after being displayed once, to thereby make a display form on that occasion different from typical one.

In addition, Patent Document 6 discloses that a call is canceled when a car other than an assigned car arrives first.

Prior Art Document

Patent Document

Patent Document 1: Japanese Patent Application Laid-Open No. 2000-272850

Patent Document 2: WO 2005/092762 (FIG. 3)

Patent Document 3: Japanese Patent Application Laid-Open No. 03-272979 (FIG. 3)

Patent Document 4: Japanese Patent Publication No. 54-014382

Patent Document 5: Japanese Patent Application Laid-Open No. 2003-012249

Patent Document 6: Japanese Patent Application Laid-Open No. 06-183652

SUMMARY OF THE INVENTION

Problem to be Solved by the Invention

In the conventional elevator group management systems as described above, an assigned car is determined immediately after a destination floor is registered in a hall, and thus it is not possible to evaluate waiting time and evaluate the number of stops in which boarding floor information and leaving floor information of passengers that are generated after the determination of assignment car are taken into account, leading to a problem that the operational efficiency is not improved.

The present invention has been made to solve the above-mentioned problem, and an object thereof is to obtain an elevator group management system having excellent operational efficiency in consideration of a status change such as boarding floor information of a passenger that has occurred in a hall after destination floor registration.

Means to Solve the Problem

An elevator group management system according to the present invention manages, in an elevator group including a plurality of cars, a finally assignment determined car among the plurality of cars in response to a demand of a passenger in a hall, which includes: a hall destination floor registration device installed in an elevator hall or a relevant floor and capable of registering a hall destination floor call for registering a destination floor by a passenger, registration contents of the hall destination floor call including a combination of a boarding floor and a destination floor registered by the passenger; a registered destination floor hall call management section storing and managing provisionally assigned car registration information; provisionally assigned car determining means determining a provisionally assigned car among the plurality of cars based on the registration contents of the registration of the hall destination floor call every time the hall destination floor call is registered, and storing the provisionally assigned car registration information in the registered destination floor hall call management section; assigned car review means extracting at least one piece of the provisionally assigned car registration information from the registered destination floor hall call management section as a review registration information set, performing assigned car review processing based on assignment evaluation indices including at least one of indices regarding waiting time until the provisionally assigned car arrives at a boarding floor and the number of stops thereof, newly determining a newly assigned car among the plurality of cars, and reregistering the newly assigned car in the registered destination floor hall call management section during a predetermined review period, the assigned car review means further executing finally assignment determined car determination processing of designating the provisionally assigned car after a lapse of the predetermined review period as a finally assignment determined car; and a finally assignment determined car display section displaying, with a destination floor assigned car notification device installed in the elevator hall or in proximity thereto, correlation information of the finally assignment determined car and a destination floor covered by the finally assignment determined car.

Effects of the Invention

The elevator group management system according to the present invention performs the assigned car review processing during a predetermined review period, and accordingly is capable of reviewing and changing, based on the assignment evaluation indices including at least one of indices regarding waiting time until the provisionally assigned car arrives at a boarding floor and the number of stops thereof, a provisionally assigned car after a passenger registers a destination floor. This enables at least one of a reduction in average waiting time and a reduction in the number of stops of the entire elevator, and an effect of improving the operational efficiency of the entire elevator is achieved.

In addition, a passenger is only required to board a finally assignment determined car by referring to the destination floor assigned car notification device, and accordingly is capable of boarding a designated car (elevator) without any confusion.

These and other objects, features, aspects and advantages of the present invention will become more apparent from the following detailed description of the present invention when taken in conjunction with the accompanying drawings.

EMBODIMENTS FOR CARRYING OUT THE INVENTION

<First Embodiment>

Figure 1:
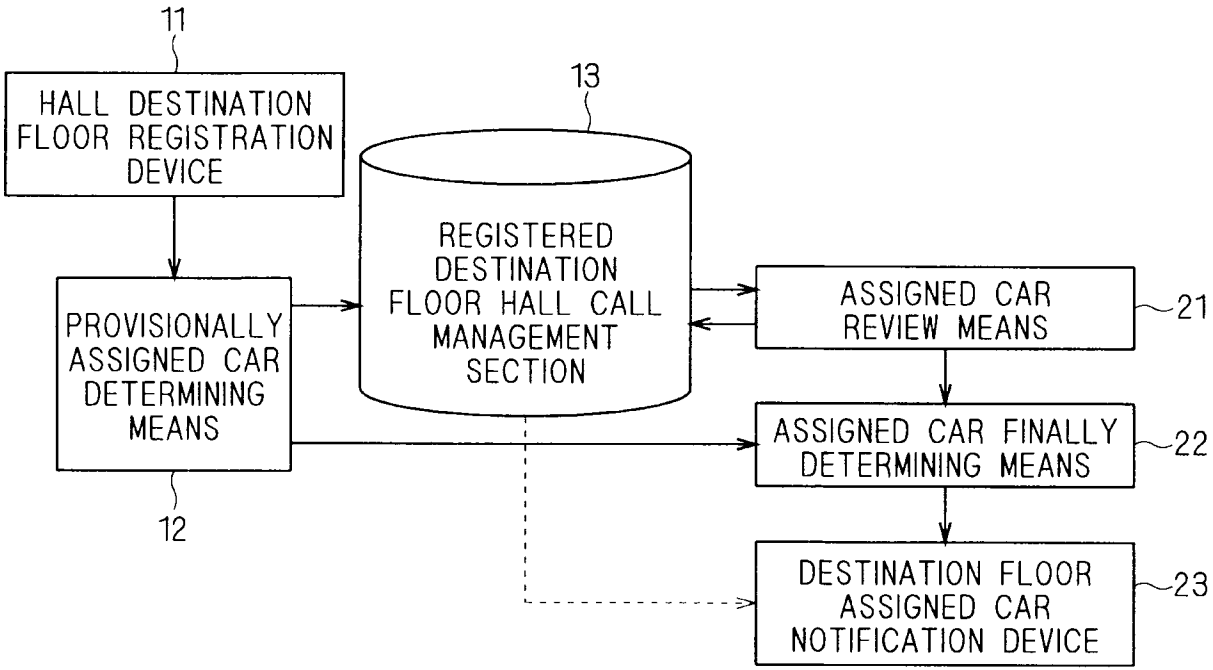
FIG. 1 is a block diagram showing the configuration of an elevator group management system according to a first embodiment of the present invention, which includes a hall destination floor registration device and performs operational management of a plurality of cars.

FIG. 1 is a block diagram showing the configuration of an elevator group management system according to a first embodiment of the present invention, which performs operational management of a plurality of cars.

Figure 2:
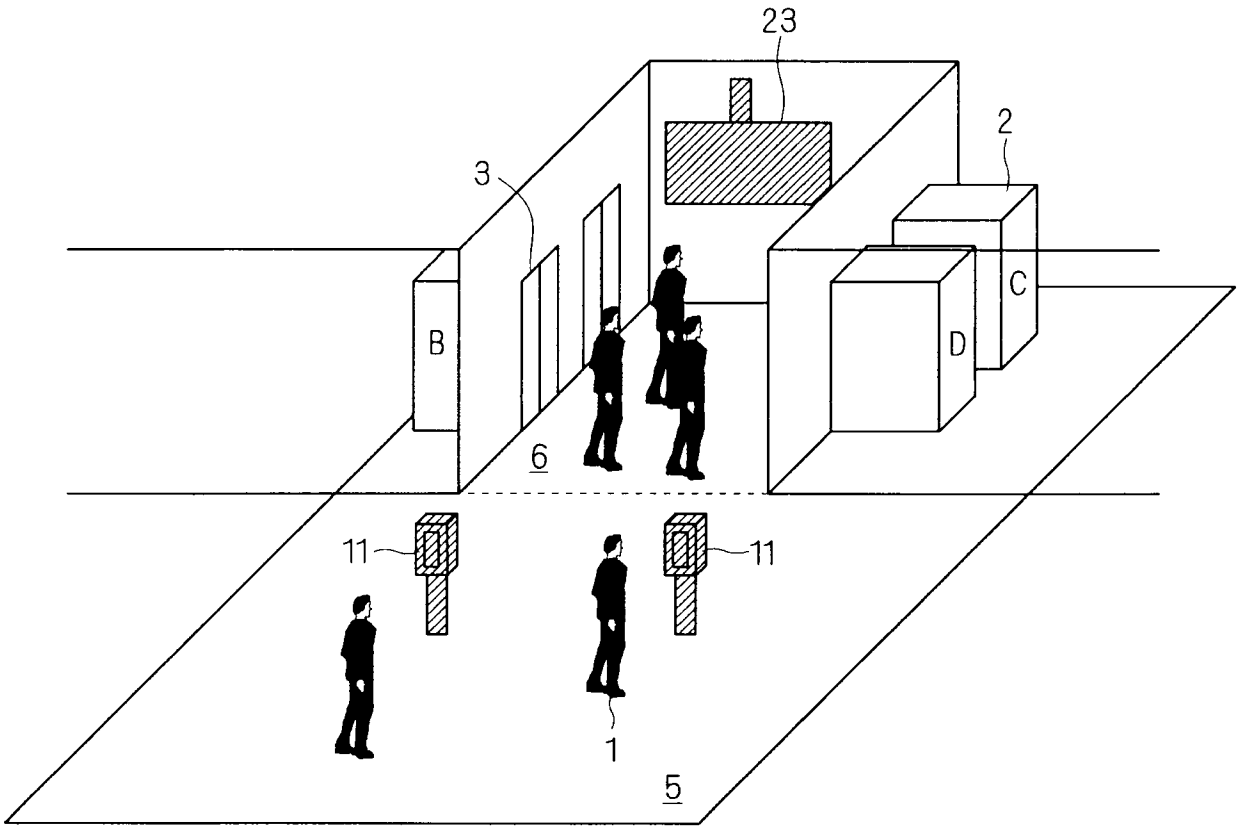
FIG. 2 is an explanatory view schematically showing the vicinity of an elevator hall of the elevator group management system including the hall destination floor registration device and a destination floor assigned car notification device.

FIG. 2 is an explanatory view schematically showing the vicinity of an elevator hall of the elevator group management system including a hall destination floor registration device and a destination floor assigned car notification device.

As shown in FIG. 2, a plurality of elevators 2 (four cars A to D) available from an elevator hall 6 in an elevator floor 5 are operated.

At least one hall destination floor registration device 11 (two in FIG. 2) is installed in the elevator floor 5, and a passenger 1 is capable of inputting an intended destination floor by operating the hall destination floor registration device 11. In the following description, the "registration of a hall destination floor call" refers to an input of a destination floor by the passenger 1 operating the hall destination floor registration device 11 in the elevator floor 5. While it is generally conceivable that the hall destination floor registration device 11 is installed in the elevator hall 6, it suffices that the hall destination floor registration device 11 is installed at least in the elevator floor 5.

Further, installed on the sidewall in the back of the elevator hall 6 is a destination floor assigned car notification device 23. The passenger 1 recognizes the elevator 2 that carries him/her to an intended destination floor by referring to the destination floor assigned car notification device 23, and waits the arrival of the elevator 2 in proximity to a jamb 3 for the elevator 2. Then, the jamb 3 opens upon arrival of the elevator 2 serving as the finally assignment determined car, whereby the passenger 1 is capable of boarding the elevator 2.

Hereinafter, the elevator group management system according to the first embodiment will be described with reference to FIG. 1. As described above, the hall destination floor registration device 11 is capable of registering a hall destination floor call by the passenger 1. Note that the hall destination floor registration device 11 has, as inherent information, the information on a boarding floor correspondingly to an installation floor thereof. Therefore, the hall destination floor registration device 11 registers a set of a boarding floor and a destination floor upon the registration processing for a hall destination floor call being performed.

Provisionally assigned car determining means 12 determines a provisionally assigned car based on the boarding floor and leaving floor of the hall destination floor call registered with the hall destination floor registration device 11, and registers, in a registered destination floor hall call management section 13, provisionally assigned car registration information in which the provisionally assigned car that has been determined. Therefore, the provisionally assigned car registration information refers to combination information of "provisionally assigned car", "destination floor" and "boarding floor". For example, in the case where one passenger 1 in the elevator floor 5 on the 1st floor registers the 5th floor as a destination floor with the hall destination floor registration device 11 and is assigned a car A as a provisionally assigned car by the provisionally assigned car determining means 12, "from 1st floor to 5th floor, car A" is the provisionally assigned car registration information.

Note that a provisionally assigned car is controlled so as to travel considering that a hall call is made on the boarding floor of the hall destination floor call that has been registered similarly to the conventional assignment. That is, an "operation command" based on the "provisionally assigned car" is made.

Figure 3:
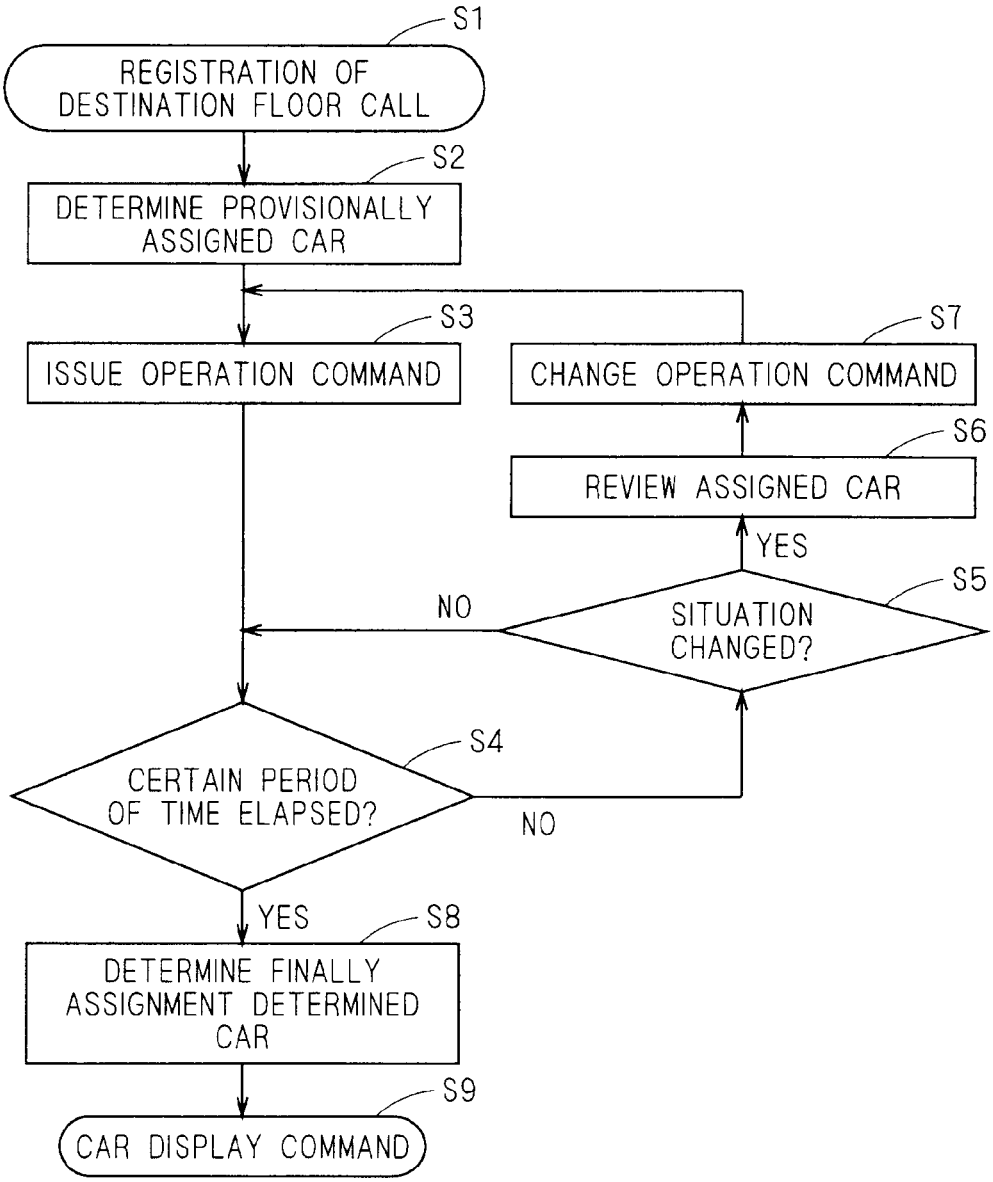
FIG. 3 is a flowchart schematically showing a process from the determination of a "provisionally assigned car" to the determination of a "finally assignment determined car".

FIG. 3 is a flowchart schematically showing the process ranging from the determination of a "provisionally assigned car" to the determination of a "finally assignment determined car" described herein. Note that FIG. 3 shows the process as a basic concept and does not show various types of exceptional processing described below.

As shown in FIG. 3, a destination floor call is registered in Step S1, and then a "provisionally assigned car" is determined in Step S2. The conventional technique may be used for determination contents in this case. After that, an operation command is issued, and NO is kept in Step S4 until a lapse of a predetermined period of time is recognized in Step S4, and thus the review-related processing of Steps S5 to S7 is performed.

Hereinafter, the review-related processing will be described. When a situation changed is recognized in Step S5 (YES), review processing for a provisionally assigned car is performed in Step S6, and a "provisionally assigned car" is changed as necessary. In Step S7, then, the contents of the operation command are changed based on the contents of the provisionally assigned car that have been changed in Step S6, and the process returns to the operation designation processing of Step S3. On the other hand, in a case where a situation change is not recognized in Step S5 (NO), the process returns to Step S4 immediately. After that, Steps S3 to S7 are repeated until a lapse of a predetermined period of time is recognized in Step S4 (YES).

Then, when a lapse of a predetermined period of time is recognized in Step S4 (YES), a "provisionally assigned car" at that time is determined as a "finally assignment determined car" in Step S8, and a car display command of the "finally assignment determined car" is output in Step S9.

"Provisional assignment" described herein is one for performing the processing described with reference to FIG. 3. That is, the "operation command" (S3) is issued immediately after an assigned car is once determined as a "provisionally assigned car" (S2), and review of the provisionally assigned car is continued (S5 to S7) during a period until a predetermined period of time has elapsed (period when S4 results in NO). Then, in a case where a change is found in an optimum provisionally assigned car, the assigned car is changed (S6) according to a situation change (such as registration of other call, longer time required for passengers than expected, and boarding of a person heavier than expected) in Step S5 and an "operation command change" is performed (S7). Then, a provisionally assigned car at the point at which a predetermined period of time has elapsed (YES in S4) is determined as the "finally assignment determined car" (S8) and, after that, the assigned car (finally assignment determined car) is displayed to passengers for the first time (S9).

As described above, "provisional assignment" described herein refers to one for reserving display to passengers while issuing an "operation command", which differs from "provisional assignment" described in the section of Background Art. Therefore, the prior arts disclosed in Patent Document 1 to Patent Document 6 described in the section of Background Art do not include the "provisionally assigned car determining means", "assigned car review means" and "assigned car finally determining means" described herein.

As described above, in issuing an operation command, the display for identifying the "provisionally assigned car" specified by the provisionally assigned car registration information is not performed by the hall destination floor registration device 11 and the destination floor assigned car notification device 23. This is because there might be a change in the contents of the provisionally assigned car registration information registered by the provisionally assigned car determining means 12.

Note that in a case where the estimated arrival time of a provisionally assigned car at a boarding floor falls within a predetermined period of time from the current time, the provisionally assigned car determining means 12 immediately sends the provisionally assigned car registration information to assigned car finally determining means 22. Upon this, the assigned car finally determining means 22 finally determines a provisionally assigned car specified by the provisionally assigned car registration information as a finally assignment determined car.

The registered destination floor hall call management section 13 stores and manages the provisionally assigned car registration information that has been registered at that time and finally assignment determined car registration information whose service has yet to be completed (information equivalent to the provisionally assigned car registration information after a provisionally assigned car is set as a finally assignment determined car). A plurality of cars are respectively operated and controlled by car operation control means (not shown) based on the information managed by the registered destination floor hall call management section 13. After the completion of service, the finally assignment determined car registration information is erased from the registered destination floor hall call management section 13.

Assigned car review means 21 executes assigned car review processing in units of review registration information sets each containing at least one piece of provisionally assigned car registration information managed by the registered destination floor hall call management section 13 during the review period. The assigned car review processing by the assigned car review means 21 will be described below in detail.

The assigned car review means 21 first retrieves, from a hall destination floor call list that contains the entire information of the provisionally assigned car registration information stored in the registered destination floor hall call management section 13, a review registration information set in which a combination of provisionally assigned car registration information for specifying the same boarding floor, the same direction and the same assigned car is bundled.

Then, the assigned car review means 21 reviews the contents of the retrieved review registration information set, and newly assigns, as a newly assigned car, an appropriate assigned car among a plurality of cars including the provisionally assigned car specified by the review registration information set, to thereby modify the provisionally assigned car of the review registration information set to a newly assigned car. The series of processing becomes the assigned car review processing (Step S6 of FIG. 3).

The assigned car review means 21 ends the assigned car review processing, and then modifies, based on the contents of the review registration information set after the modification, the contents of the provisionally assigned car registration information in the registered destination floor hall call management section 13. The processing of modifying the contents of the provisionally assigned car registration information is equivalent to the "operation command change" processing described in Step S7 of FIG. 3 and, thereafter, the "operation command" of Step S3 is issued based on the contents of the "operation command change" in Step S7.

However, in an exceptional case where the estimated arrival time of the provisionally assigned car in its direction at the boarding floor thereof is approaching a predetermined period of time from the current time, the assigned car review means 21 excludes it from the review period. That is, the assigned car review means 21 does not perform the assigned car review processing beyond the review period but immediately sends the information of the review registration information set to the assigned car finally determining means 22. Upon this, the assigned car finally determining means 22 finally determines, as a finally assignment determined car, the provisionally assigned car specified by at least one piece of provisionally assigned car registration information in the review registration information set. It is typically desirable that the value of the predetermined period of time after which the assigned car review means 21 terminates the assigned car review processing be a value of approximately 5 seconds to 20 seconds. That is, the assigned car review means 21 does not perform the assigned car review processing at the timing 5 seconds to 20 seconds before the arrival of the provisionally assigned car at the relevant floor because it is regarded to be beyond the review period.

The assigned car finally determining means 22 performs the processing of finally determining assigned car according to a destination floor of each floor based on the provisionally assigned car registration information and the review registration information set sent from the provisionally assigned car determining means 12 and the assigned car review means 21, and notifies the destination floor assigned car notification device 23 on the corresponding floor of the finally determined information (destination floor and finally assignment determined car).

The destination floor assigned car notification device 23 is installed in the hall or in proximity to the hall entrance of the floor and, based on the finally determined information obtained from the assigned car finally determining means 22, displays a finally assignment determined car and a destination floor thereof on a given display section. That is, the destination floor assigned car notification device 23 displays the correlation information of the finally assignment determined car and the destination floors covered by the finally assignment determined car.

Figure 4:
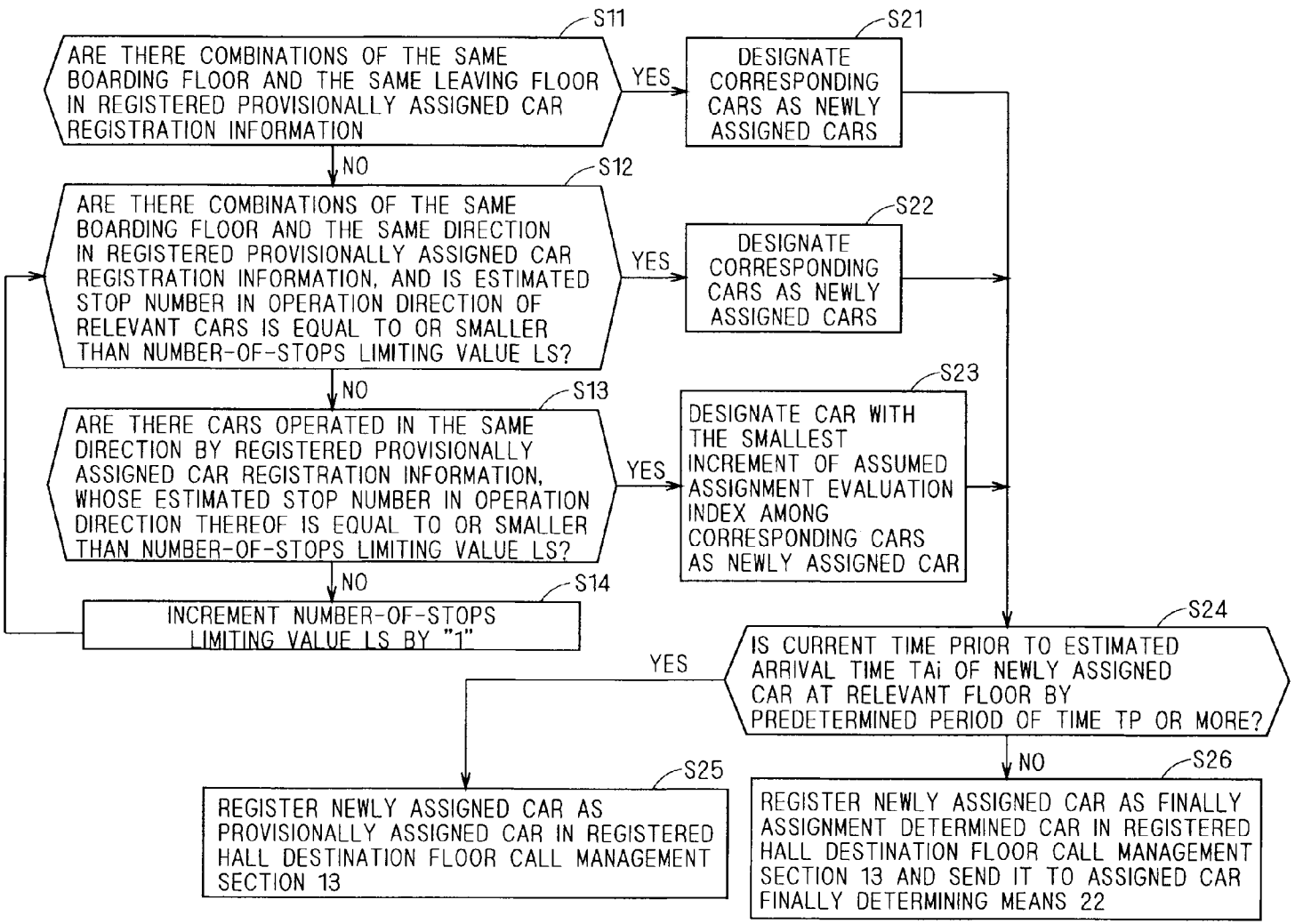
FIG. 4 is a flowchart showing a mode of determining a provisionally assigned car by hall destination floor call provisionally registering means shown in FIG. 1.

FIG. 4 is a flowchart showing the mode of determining a provisionally assigned car by the provisionally assigned car determining means 12 shown in FIG. 1. Hereinafter, the contents of the mode of determining a provisionally assigned car will be described with reference to this figure. Note that the mode of determining a provisionally assigned car is the processing performed by the provisionally assigned car determining means 12 immediately after the passenger 1 registers a destination floor with the hall destination floor registration device 11. Here, description will be given by taking, as an example, the case where the passenger 1 registers a destination floor Y with the hall destination floor registration device 11 in the elevator floor 5 of the boarding floor X.

First, in Step S11, the presence or absence of the provisionally assigned car registration information in which a combination of the same boarding floor and the same destination floor as the boarding floor X and the destination floor Y is checked from the hall destination floor call list that has already been registered in the registered destination floor hall call management section 13.

In a case where there is the provisionally assigned car registration information in which the combination of the same boarding floor and the same destination floor as the boarding floor X and the destination floor Y is specified (YES in Step S11), in Step S21, a provisionally assigned car (relevant car) specified by the provisionally assigned car registration information is designated as a newly assigned car for the boarding floor X and the destination floor Y, and then the process proceeds to Step S24.

In a case where there is no provisionally assigned car registration information in which the combination of the same boarding floor and the same destination floor as the boarding floor X and destination floor Y is specified (NO in Step S11), in Step S12, whether or not there is the provisionally assigned car registration information in which a combination of the same boarding floor and the same direction as the boarding floor X and the operation direction from the boarding floor X to the destination floor Y is specified is checked from the hall destination floor call list that has been already registered as a first condition in the registered destination floor hall call management section 13.

Further, in a case where there is the provisionally assigned car registration information satisfying the first condition, it is checked whether or not the provisionally assigned car (relevant car) specified by the provisionally assigned car registration information satisfies a second condition that an estimated number of stops in the operation direction thereof is equal to or smaller than a number-of-stops limiting value LS.

Then, when the first and second conditions of Step S12 are satisfied (YES in Step S12), in Step S22, the provisionally assigned car (relevant car) specified by the provisionally assigned car registration information is designated as a newly assigned car for the boarding floor X and the destination floor Y, and then the process proceeds to Step S24.

On the other hand, in a case where the first or second condition of Step S12 is not satisfied (NO in Step S 12), in Step S13, it is checked whether or not there is a car operated in the same direction as the operation direction from the boarding floor X to the destination floor Y in the provisionally assigned car registration information that has already been registered in the registered destination floor hall call management section 13, and whether an estimated number of stops in the operation direction of the car is equal to or smaller than the number-of-stops limiting value LS.

In the check of Step S13 described above, it is checked whether or not there is a car that has not been planned for boarding on the floor on which a hall destination floor call has been registered, is capable of using the relevant floor as a boarding floor, and has an estimated number of stops equal to or smaller than the number-of-stops limiting value LS.

Then, when the conditions of Step S13 are satisfied (YES in Step S13), in Step S23, an assignment evaluation index, which is assumed in a case where the provisionally assigned cars (relevant cars) respectively specified by pieces of the assigned car registration information are assigned to the boarding floor X and the destination floor Y, is calculated, and a provisionally assigned car with the smallest increment of the calculated assignment evaluation index is designated as a newly assigned car for the boarding floor X and the destination floor Y. After the execution of Step S23, the process proceeds to Step S24.

The Step S23 described above is the processing predicated on the fact that there are a plurality of cars that satisfy the conditions of Step S13. Accordingly, in a case of only one car that satisfies the conditions of Step S13, this car serves as a newly assigned car for the boarding floor X and the destination floor Y.

On the other hand, in a case where the conditions of Step S13 are not satisfied (NO in Step S13), in Step S14, the number-of-stops limiting value LS is incremented by "1", and the process returns to Step S12.

After that, Steps S12 to S14 are repeated until Step S12 or Step S13 results in YES.

In Step S24 executed after each of Steps S21 to S23, it is checked whether the current time is prior to the estimated arrival time TAi in the same operation direction of the newly assigned car, which has been set through Steps S21 to S23, in the boarding floor by a predetermined period of time TP or more (YES) or not (NO). That is, in the case of YES in Step S24, it is determined that the current time falls within the review period of the assigned car review processing by the provisionally assigned car determining means 12, whereas in the case of NO in Step S24, it is determined beyond the review period.

In Step S25 executed in the case of YES in Step S24 (within the review period), the information in which the newly assigned car set in any of Steps S21 to S23 is associated as a provisionally assigned car for the boarding floor X and the destination floor Y is registered as new provisionally assigned car registration information in the registered destination floor hall call management section 13.

On the other hand, in Step S26 executed in the case of NO in Step S24 (beyond the review period), the information in which the newly assigned car set in any of Steps S21 to S23 is associated as a finally assignment determined car for the boarding floor X and the destination floor Y is registered as finally assignment determined car registration information in the registered destination floor hall call management section 13 and is also sent to the destination floor assigned car notification device 23.

As described above, in the case where the current time is judged to be beyond the review period (NO) in Step S24, a finally assignment determined car can be immediately determined in Step S26, and accordingly the provisionally assigned car determining means 12 is allowed to determine a provisionally assigned car without interfering with operations of a plurality of cars.

Figure 5:
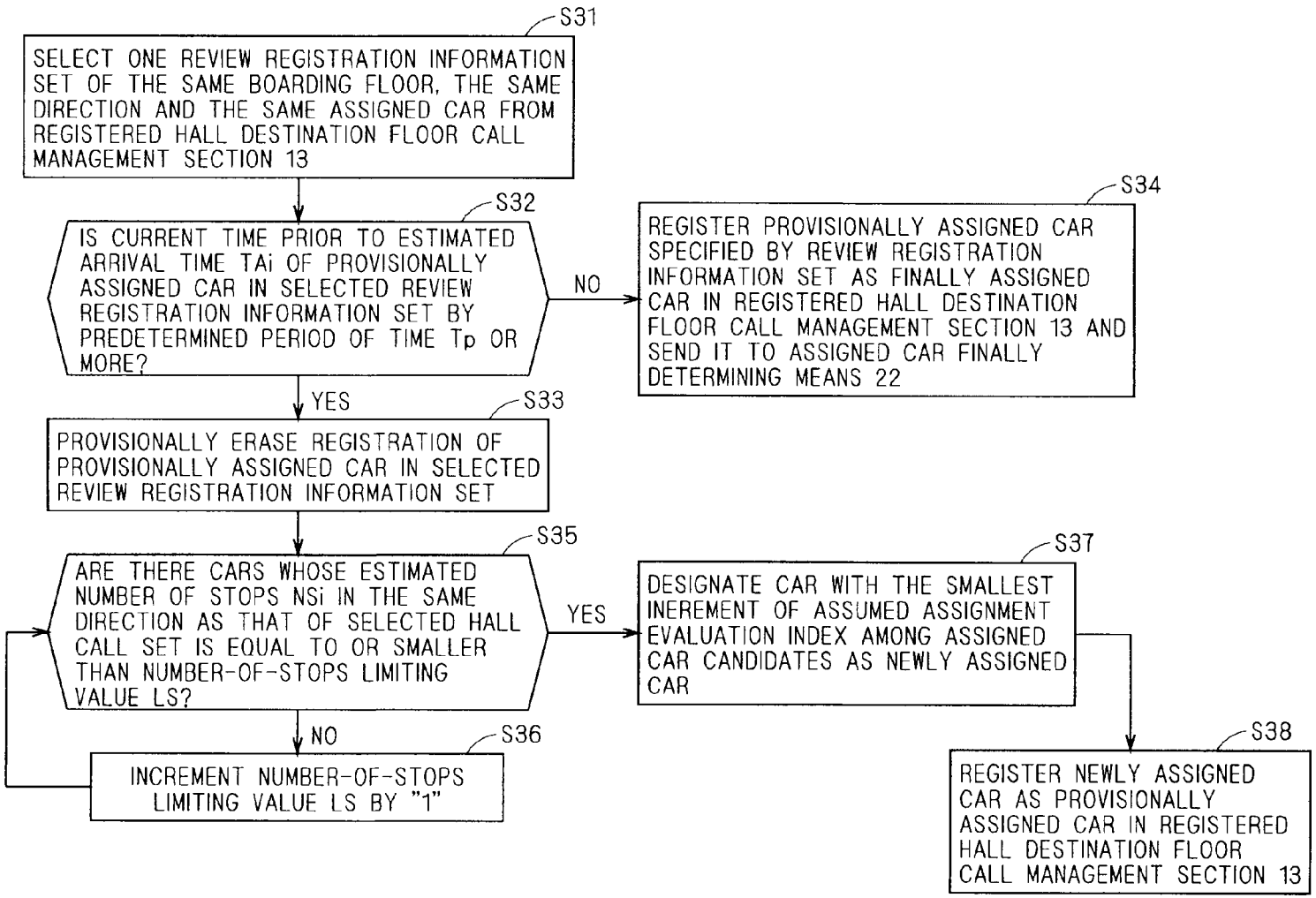
FIG. 5 is a flowchart showing the contents of assigned car review processing and finally assignment determined car determination processing by assigned car review means shown in FIG. 1.

FIG. 5 is a flowchart showing the assigned car review processing and finally assignment determined car determination processing by the assigned car review means 21 shown in FIG. 1. The procedures of those processings will be described with reference to this figure.

First, in Step S31, one review registration information set in which a combination of the provisionally assigned car registration information corresponding to the same boarding floor, the same direction and the same assigned car is bundled is retrieved from the hall destination floor call list that contains the entire information regarding the provisionally assigned car registration information managed by the registered destination floor hall call management section 13 per unit time.

For example, three pieces of provisionally assigned car registration information, "1st floor (boarding floor) to 5th floor (leaving floor), car A", "1st floor to 6th floor, car A" and "1st floor to 8th floor, car A", are managed by the registered destination floor hall call management section 13, and the assigned car review means 21 retrieves those three pieces of information as one review registration information set. This is because the same boarding floor (1st floor), the same direction (upward direction) and the same assigned car (car A) are specified in those three pieces of provisionally assigned car registration information.

Further, in order to avoid the event in which the provisionally assigned car registration information of the same contents is repeatedly selected and the occurrence of provisionally assigned car registration information of the same contents that is not selected, there is conceivable, for example, the processing in which different identifications (IDs) are added and managed per unit of provisionally assigned car information and the provisionally assigned car registration information is selected in order of IDs by the registered destination floor hall call management section 13.

Next, in Step S32, it is checked whether the current time is prior to the estimated arrival time TAi in the operation direction toward the boarding floor of the provisionally assigned car in the review registration information set by the predetermined period of time TP or more (YES) or not (NO). That is, in the first embodiment, the period from the registration of the provisionally assigned car registration information to the time prior to the estimated arrival time TAi of the corresponding provisionally assigned car by the predetermined period of time TP is designated as a review period. That is, YES/NO of Step S32 is equivalent to NO/YES of Step S4 shown in FIG. 3.

In the case where the estimated arrival time TAi of the selected review registration information set falls within the predetermined period of time TP from the current time (NO) in Step S32, it is regarded to be beyond the review period, and the process proceeds to Step S34.

In Step S34, the information in which the provisionally assigned car specified by the review registration information set is associated as the finally assignment determined car that operates from the boarding floor to the respective destination floors that is specified by the review registration information set is registered as the finally assignment determined car registration information in the registered destination floor hall call management section 13 and, at the same time, the finally assignment determined car determination processing of sending it to the destination floor assigned car notification device 23 is executed. Then, the processing is ended. The processing of Step S34 is equivalent to the processing of Step S8.

On the other hand, in the case where the estimated arrival time TAi of the selected review registration information set is prior to the current time by the predetermined period of time TP or more (YES) in Step S32, the current time is judged to be within the review period, and the assigned car review processing of Steps S33 and S35 to S38 is executed (which is equivalent to Step S6 of FIG. 3).

In Step S33, registration in the provisionally assigned car specified by the selected review registration information set is provisionally erased. After the provisional erasure, it is assumed that the contents of review registration information set have not been registered in the assigned car review processing. However, the operation of the provisionally assigned car in a provisionally erased state continues to be controlled.

After that, in Step S35, it is checked whether there is a car whose estimated number of stops NSi in the same direction as the operation direction specified by the selected review registration information set is equal to or smaller than the number-of-stops limiting value LS (YES) or not (NO).

In the case where it is judged that the estimated number of stops NSi is larger than the number-of-stops limiting value LS (NO) in Step S35, in Step S36, the number-of-stops limiting value LS is incremented by "1", and the process returns to Step S35. After that, Steps S35 and S36 are repeated until Step S36 results in YES.

On the other hand, in the case where it judged that the estimated number of stops NSi is equal to or smaller than the number-of-stops limiting value LS (YES) in Step S35, the process proceeds to Step S37. Hereinafter, the car that has been judged whose estimated number of stops NSi is equal to or smaller than the number-of-stops limiting value LS is referred to as an "assigned car candidate".

In Step S37, an assignment evaluation index assumed in a case where the assigned car candidates are respectively assigned to the cars specified by the review registration information set is calculated, and the assigned car candidate with the smallest increment of the calculated assignment evaluation index is designated as a newly assigned car.

Then, in Step S38, the newly assigned car selected in Step S37 is modified as a new provisionally assigned car specified by the review registration information set and is registered in the registered destination floor hall call management section 13. In this case, the provisionally assigned car in the provisionally erased state in Step S33 is actually erased, and the operation control for the provisionally assigned car that has been actually erased is stopped. Then, operation control for the new provisionally assigned car is performed.

For example, in a case where a "car B" is set as a newly assigned car in Step S37 as to the above-mentioned review registration information set {"1st floor to 5th floor, car A", "1st floor to 6th floor, car A" and "1st floor to 8th floor, car A"}, in Step S38, the contents of three pieces of provisionally assigned car registration information are registered as "1st floor to 5th floor, car B", "1st floor to 6th floor, car B" and "1st floor to 8th floor, car B". In this manner, the assigned car review means 21 registers new provisionally assigned car registration information after the review and erases the provisionally assigned car registration information before the review at the same time.

Next, description will be given of the assignment evaluation indices used in the processings of Step S23 of FIG. 4 and Step S37 of FIG. 5. Here, the relevant car in Step S23 and the assigned car candidate in Step S37 are designated as a car C. Moreover, the combination of the boarding floor X, the destination floor Y and the car in Step S23 and the combination of the boarding floor, the destination floor (in some cases, a plurality of destination floors), and the car specified by the review registration information set in Step S37 are referred to as an "intended hall destination floor call".

Wbef(C) and Waft(C) represent sums of the squares of waiting time on hall call stop floor (boarding floor) of the car C before the intended hall destination floor call is assigned to the car C and after it is assigned thereto, respectively. Further, Sbef(C) and Saft(C) represent the number of stops of the car C before the intended hall destination floor call is assigned to the car C and after it is assigned thereto, respectively. Similarly, Abef(C) and Aaft(C) represent the evaluation values of the other evaluation values of the car C before the intended hall destination floor call is assigned to the car C and after it is assigned thereto, respectively. The other evaluation values include a sum of estimated car boarding time and the car running distance. The sum of estimated car boarding time represents the sum of periods of time when a passenger of the relevant car is within the car. In this case, the assignment evaluation indices Vbef(C) and Vaft(C) of the car C before the intended hall destination floor call is assigned to the car C and when it is assigned thereto are expressed by Equation (1) and Equation (2) below, where k1, k2 and k3 each represent a weight factor. The assigned car of the intended hall destination floor call is the car C in which the value of "Vaft(C)−Vbef(C)" is minimized.

$$Vbef(C)=k1*Wbef(C)+k2*Sbef(C)+k3*Abef(C) \quad (1)$$

$$Vaft(C)=k1*Waft(C)+k2*Saft(C)+k3*Aaft(C) \quad (2)$$

Therefore, the assignment evaluation indices used in the processings of Step S23 and Step S37 of FIG. 5 represent, for example, "Vaft(C)−Vbef(C)" described above.

The assigned car review means 21 performs the assigned car review processing as the review registration information set including a combination of the provisionally assigned car registration information in which the same boarding floor, the same direction and the same assigned car are specified.

Therefore, the elevator group management system according to the first embodiment performs the assigned car review processing per information group in which the provisionally assigned car registration information that specifies the same boarding floor, the same operation direction and the same provisionally assigned car is bundled, whereby it is possible to reduce the time required for the assigned car review processing.

However, not limited thereto, the combination of the provisionally assigned car registration information in which the same boarding floor, the same destination floor and the same assigned car are specified may be used as review registration information set.

In this case, the elevator group management system according to the first embodiment performs the assigned car review processing per information group in which the provisionally assigned car registration information that specifies the same boarding floor, the same destination floor and the same assigned car is bundled, which simplifies operation for reviewing the assignment. Further, compared with the case where the provisionally assigned car registration information in which the same boarding floor, the same operation direction and the same provisionally assigned car are specified is bundled, the contents to be bundle are more detailed. Accordingly, there can be achieved an effect that assignment review that takes the number of stops in one round of a car more into account is enabled.

Alternatively, one unit of the provisionally assigned car registration information registered by the provisionally assigned car determining means 12 in which a destination floor has been input on an individual passenger basis, that is, input with the hall destination floor registration device 11 may be used as the review registration information set without change.

In this case, the elevator group management system according to the first embodiment is capable of more specific assigned car review processing for each passenger who uses an elevator.

Further, while in Step S31 of FIG. 5, the combination of provisionally assigned car registration information that specifies the same boarding floor, the same direction and the same assigned car is selected as one unit of review registration information set from the registered destination floor hall call management section 13, a plurality of units of review registration information sets may be selected at the same time, and the assigned car review processing of Step S32 and thereafter may be performed. This means that provisionally erase processing of Step S33 is performed at the same time with the plurality of units of review registration information sets in this case.

While in Step S31 of FIG. 5, the provisionally assigned car registration information in which the same boarding floor, the same direction and the same assigned car are specified is selected from the registered destination floor hall call management section 13 in an order of IDs, the provisionally assigned car registration information may be selected at random using pseudo-random numbers. In short, it is only required to avoid the event in which the provisionally assigned car registration information of the same contents is repeatedly selected and the occurrence of provisionally assigned car registration information of the same contents that is not selected.

The assigned car review means 21 performs the assigned car review processing in the review period prior to, by the predetermined period of time TP, the estimated arrival time TAi of the provisionally assigned car specified by the provisionally assigned car registration information at a boarding floor in the same direction.

In contrast to this, the assigned car review processing may be performed with a uniform predetermined period of time, which has been determined in advance, after the registration of hall destination floor call using the hall destination floor registration device 11 as the review period.

In this case, the elevator group management system according to the first embodiment is capable of determining a finally assignment determined car without fail after a lapse of a predetermined period of time from the registration of hall destination floor call, which enables passengers to board a designated car without any confusion.

Further, in the case where the hall destination floor registration device 11 is provided in a place a little away from the elevator hall 6 as shown in FIG. 2, a value obtained by adding/subtracting the predetermined period of time to/from the time required for walk from the installation place of the hall destination floor registration device 11 to the elevator hall 6 may be set as the uniform predetermined period of time from the registration of hall destination floor call.

In this case, in the elevator group management system according to the first embodiment, a finally assignment determined car is determined at the timing at which the passenger 1 walks from the hall destination floor call registration device 11 to the elevator hall 6. Accordingly, the passenger 1 is capable of boarding a designated car without any confusion by referring to the finally assignment determined car from the destination floor assigned car notification device 23.

Note that the hall destination floor registration device 11 is not limited to the device that registers destination floors in the form of ten-key touch panel but may be the device that operates together with personal authentication apparatuses such as a car reader and a security gate and registers destination floors.

Further, the hall destination floor registration device 11 is not installed only in the case where it is installed on a floor of every floor level, but may be installed only on a specific floor such as a lobby floor such that the direction of a destination floor is allowed to be input using a simple up/down (UPDN) button on other floors.

In the present embodiment, the provisionally assigned car registration information in which a destination floor call has been registered with the hall destination floor registration device 11 and has been registered by the provisionally assigned car determining means 12 is caused to perform the assigned car review processing by the assigned car review means 21 during the review period from the registration of destination floor call to the time prior to the estimated arrival time TAi at the boarding floor of the provisionally assigned car toward the direction thereof by the predetermined period of time TP.

Instead of this, in a case where a special type of passenger information such as designation of a handicapped person or designation of a very important person (VIP) is also registered with the hall destination floor registration device 11, immediately, the provisionally assigned car assigned by the provisionally assigned car determining means 12 may be determined finally as a finally assignment determined car without executing the assigned car review processing by the assigned car review means 21. In this case, a destination floor and a finally assignment determined car may be displayed on at least one of a display device attached to the hall destination floor registration device 11 and a display device installed in an elevator hall or the hall entrance.

While in registration by the provisionally assigned car determining means 12, the information regarding the provisionally assigned car is not displayed on the hall destination floor registration device 11 and the destination floor assigned car notification device 23, the information regarding the provisionally assigned car may be displayed once on at least one of the hall destination floor registration device 11 and the destination floor assigned car notification device 23.

Then, the finally assignment determined car may be displayed in the destination floor assigned car notification floor device 23 in a changeable manner after the finally assignment determined car is determined by the assigned car finally determining means 22.

For example, the destination floor assigned car notification device 23 may also display a destination floor of a provisionally assigned car that has been registered in the registered destination floor hall call management section 13 as in the case where a destination floor of the finally assignment determined car is displayed.

That is, at least one of the hall destination floor registration device 11 and the destination floor assigned car notification device 23 may further have a provisionally assigned car display function of displaying a provisionally assigned car specified by the provisionally assigned car registration information.

In this case, the elevator group management system according to the first embodiment is capable of displaying a provisionally assigned car in advance by the function of displaying a provisionally assigned car, whereby the passenger 1 can get rid of anxiety that a car to board may not be displayed.

According to the first embodiment of the above-mentioned configuration, a hall destination floor call is registered with the hall destination floor registration device 11, and even if a provisionally assigned car is registered by the provisionally assigned car determining means 12, an assigned car is not determined according to a destination floor immediately thereafter but, as described above, the assigned car review means 21 performs the assigned car review processing based on the review registration information set.

This enables the assigned car review means 21 to perform the assignment review processing using the review registration information set such that an increment of the above-mentioned assignment evaluation index is minimized, which makes it possible to follow situation changes due to a reduction in the number of stops of each car, an occurrence of a new passenger after the registration of provisionally assigned car registration information, and car moving. Accordingly, there can be obtained an effect that the operational efficiency of the elevator group management system according to the first embodiment can be improved.

As described above, the assigned car review means 21 of the elevator group management system according to the present embodiment performs the review processing for an assigned car during the review period from the registration of provisionally assigned car registration information to the time prior to the estimated arrival time TAi of a corresponding provisionally assigned car by the predetermined period of time TP. Therefore, the elevator group management system according to the present embodiment is capable of reviewing and changing, after a passenger registers a hall destination floor call, a provisionally assigned car based on the assignment evaluation indices including the indices regarding the waiting time before the estimated arrival time TAi and the number of stops of a provisionally assigned car. This reduces the average waiting time and the number of stops of the entire elevator, whereby an effect that the operational efficiency of the entire elevator can be improved is achieved.

Note that a provisionally assigned car may be reviewed and changed based on any one of the assignment evaluation indices of the indices regarding the waiting time until the estimated arrival time TAi and the number of stops of a provisionally assigned car. In this case, there is achieved an effect that any one of the average waiting time and the number of stops of the entire elevator can be reduced.

Further, a passenger is only required to board a finally assignment determined car by referring to the destination floor assigned car notification device 23, and accordingly is capable of boarding a designated car without any confusion.

<Second Embodiment>

Figure 6:
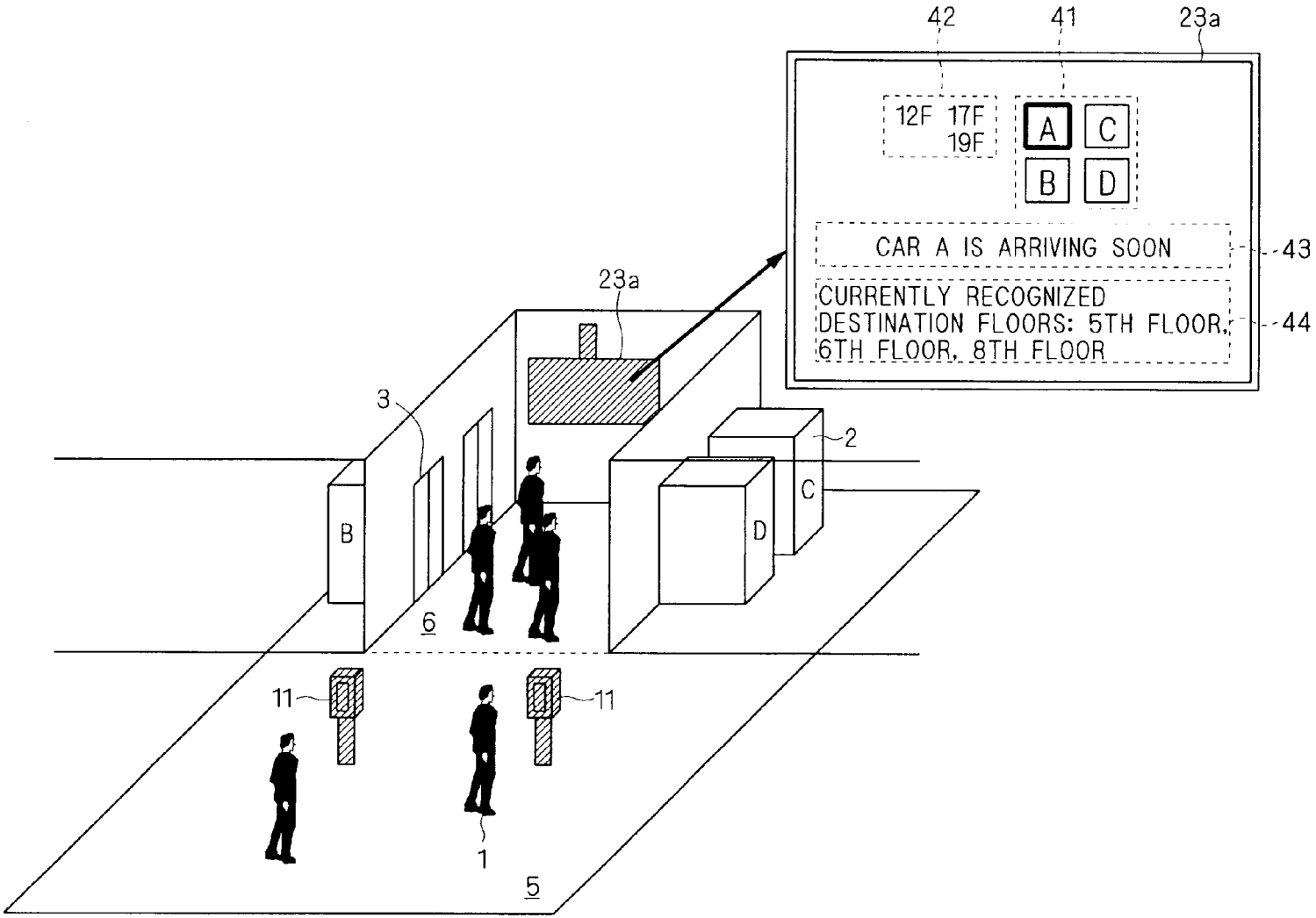
FIG. 6 is an explanatory view showing a first aspect of a destination floor assigned car notification device in an elevator group management system according to a second embodiment of the present invention.

FIG. 6 is an explanatory view showing a first aspect of the destination floor assigned car notification device 23 in an elevator group management system according to a second embodiment of the present invention.

As shown in this figure, a destination floor assigned car notification device 23*a* of the first aspect is installed on the sidewall in the back of the hall entrance of the elevator hall 6. The destination floor assigned car notification device 23*a* employs a mode of displaying destination floors that have been finally determined for each car.

The destination floor assigned car notification device 23*a* mainly includes an assigned car display section 41, a finally determined destination floor display section 42 and a message display section 43.

The assigned car display section 41 displays a car arrangement by "A to D" in map form according to the arrangement of a car (elevator) A to a car D with respect to the elevator hall 6.

When receiving final determination information from the assigned car finally determining means 22, the destination floor assigned car notification device 23*a* displays the destination floors specified by the final determination information on the finally determined destination floor display section 42 adjacent to the car display of the assigned car display section 41 that indicates a finally assignment determined car specified by the final determination information. FIG. 6 shows the example in which a finally assignment determined car is the "car A" and destination floors are the "12th floor", "17th floor" and "19th floor". That is, the destination floor "12th floor" and the like appear on the finally determined destination floor display section 42 adjacent to "car A".

Further, the destination floor assigned car notification device 23*a* displays a message saying, for example, "Car A is arriving soon" on the message display section 43 in a case where the estimated arrival time in its direction of an assigned car (finally assignment determined car) at the boarding floor is approaching a predetermined period of time.

In this case, the passenger 1 is notified that the car A is arriving soon by changing a square frame of the assigned car in the assigned car display section 41 into a thick frame (see FIG. 6), causing the square frame to flash, or changing a display color within the square frame. Alternatively, notification may be made by chiming and causing an arrival light next to the jamb of the intended car to turn on at the same time.

Further, in the destination floor assigned car notification device 23*a*, though not specified in the final determination information, destination floors whose hall destination floor call has been registered by the hall destination floor registration device 11 may be displayed on a recognition-in-process destination floor display section 44. For example, in the example of FIG. 6, the recognition-in-process destination floor display section 44 displays that the destination floors that are currently being recognition are the 5th floor, 6th floor and 8th floor. Note that in this case, the destination floor assigned car notification device 23*a* needs to be configured so as to obtain the provisionally assigned car registration information from the registered destination floor hall call management section 13 (indicated by a broken line of FIG. 1).

In this case, the elevator group management system according to the second embodiment recognizes that the registration of hall destination floor call by the hall destination floor registration device 11 has been recognized by referring to the recognition-in-process destination floor display section 44, and accordingly is capable of easily recognizing the fact that an assigned car has not been finally determined.

While destination floors are displayed next to an assigned car in the finally determined destination floor display section 42, those may be displayed in a square frame of an assigned car, above or below an assigned car.

With the configuration as in the first aspect of the second embodiment, destination floors are collectively displayed within one destination floor assigned car notification device 23*a* correspondingly to an arrangement map of assigned cars. This enables the passenger 1 to easily recognize an assigned car to board for going to his/her desired destination floor by referring to the destination floor assigned car notification device 23*a*.

Further, the configuration, in which destination floor information of own car is displayed using car-based destination floor display devices installed in the vicinity of the jambs 3 of the respective cars in place of the destination floor assigned car notification device 23*a* installed in the elevator hall 6 or in the vicinity of the hall entrance, is conceivable as a second aspect.

Figure 7:
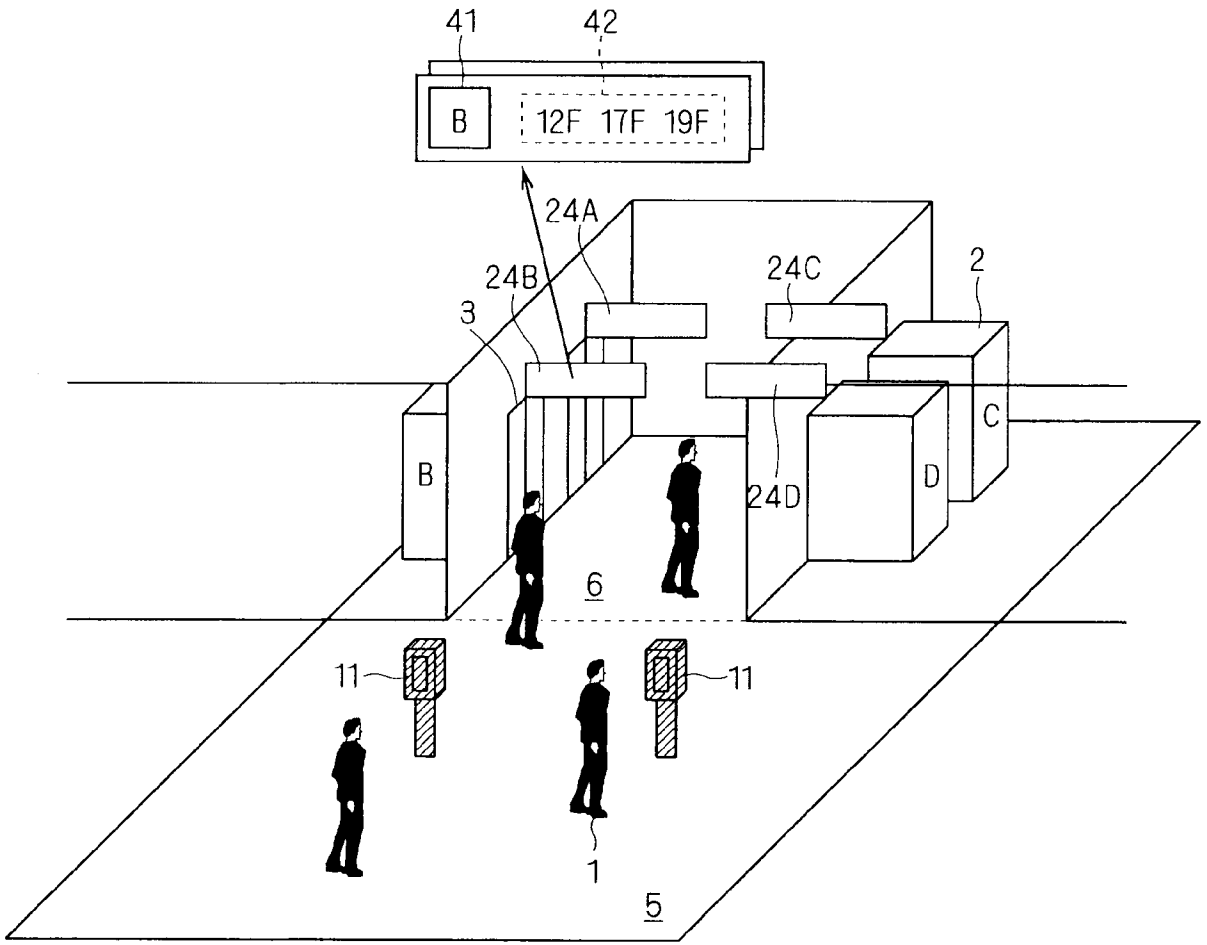
FIG. 7 is an explanatory view showing a second aspect of the destination floor assigned car notification device in the elevator group management system according to the second embodiment of the present invention.

FIG. 7 is an explanatory view showing the second aspect of the destination floor assigned car notification device 23 in the elevator group management system according to the second embodiment of the present invention.

As shown in this figure, car-based destination floor display devices 24A to 24D (a plurality of destination floor display devices) according to the second aspect of the destination floor assigned car notification device 23 are disposed above the jambs 3 corresponding to the cars A to D, each of which displaying destination floor information and the number of the corresponding car. In this manner, the car-based destination floor display devices 24A to 24D correspond to the car A to the car D and are disposed in the vicinity of the cars A to D in the elevator hall 6, respectively.

In the example of FIG. 7, the car-based destination floor display device 24B disposed above the jamb 3 of the car B displays the number of own car on the assigned car display section 41, and displays destination floors "12th floor", "17th floor" and "19th floor" on the finally assigned destination floor display section 42.

With the configuration as described in the second aspect of the second embodiment, destination floors are displayed in the car-based destination floor display devices 24A to 24D each provided correspondingly to the assigned cars. This enables a passenger to easily recognize an assigned car to board for going to his/her desired destination floor without error.

<Third Embodiment>

Figure 8:
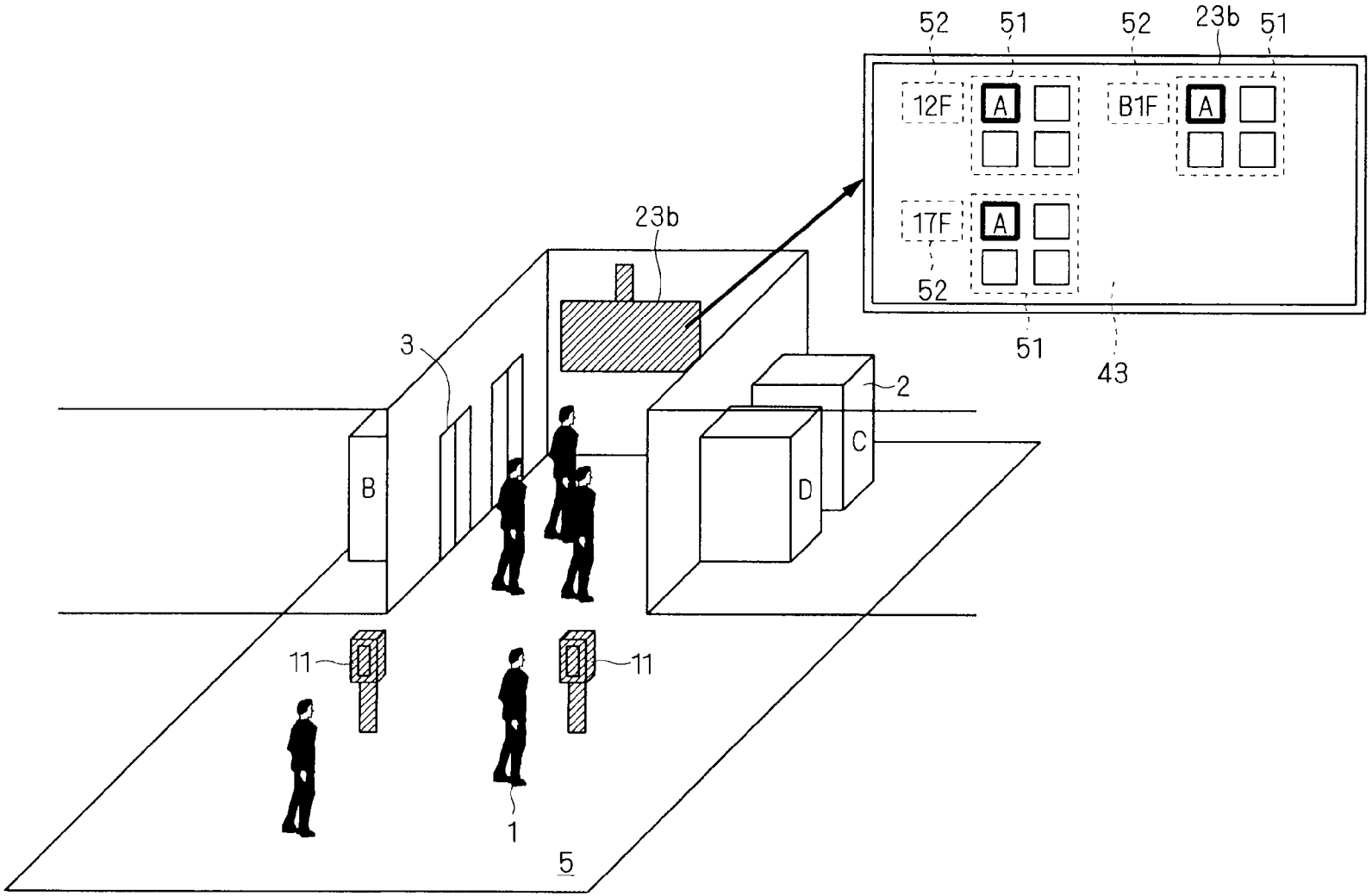
FIG. 8 is an explanatory view showing a specific example of a destination floor assigned car notification device in an elevator group management system according to a third embodiment of the present invention.

FIG. 8 is an explanatory view showing a specific example of the destination floor assigned car notification device 23 in an elevator group management system according to a third embodiment of the present invention.

As shown in this figure, a destination floor assigned car notification device 23*b* is installed on the sidewall in the back of the hall entrance in the elevator hall 6, similarly to the destination floor assigned car notification device 23*a* according to the first aspect of the second embodiment. The destination floor assigned car notification device 23*b* employs the mode of displaying assigned cars according to a destination floor.

The destination floor assigned car notification device 23*b* mainly includes destination floor assigned car display sections 51 and finally determined destination floor display sections 52. The third embodiment is characterized in that the destination floor assigned car display section 51 is provided correspondingly to each finally determined destination floor display section 52.

The destination floor assigned car notification device 23*b* displays the destination floor that has been finally determined on the finally determined destination floor display section 52.

The destination floor assigned car notification device 23*b* displays, on the destination floor assigned car display sections 51 adjacent to displays of the destination floors of the finally determined destination floor display sections 52 that indicate the destination floors specified by the final determination information, the finally assignment determined cars in map form according to a car arrangement with respect to the elevator hall 6. Then, the destination floor assigned car display section 51 does not display the numbers of unassigned cars other than the finally assignment determined car by making frames thereof thin.

In the example shown in FIG. 8, "12th floor", "17th floor" and "B1 F" are respectively displayed in the finally determined destination floor display sections 52, and the fact that the "car A" is the finally assignment determined car is displayed on the destination floor assigned car display sections 51 that are respectively adjacent to the finally determined destination floor display sections 52 that display "12th floor", "17th floor" and "B1 F".

While the destination floor assigned car display sections 51 display assigned cars according to a destination floor in map form of car arrangement, those may display only the number of an assigned car such as "A", in combination with a destination floor.

According to the third embodiment of the above-mentioned configuration, assigned cars corresponding to the respective floors are correctively displayed in one destination floor assigned car notification device 23*b*. This enables a passenger to easily recognize an assigned car to board for going to his/her desired destination floor.

While the invention has been shown and described in detail, the foregoing description is in all aspects illustrative and not restrictive. It is therefore understood that numerous modifications and variations can be devised without departing from the scope of the invention.

The invention claimed is:

1. An elevator group management system that manages, in an elevator group including a plurality of cars, a finally assignment determined car among said plurality of cars in response to a demand of a passenger in a hall, comprising:

a hall destination floor registration device installed in an elevator hall or a relevant floor and capable of registering a hall destination floor call for registering a destination floor by a passenger, registration contents of said hall destination floor call including a combination of a boarding floor and a destination floor registered by said passenger;

a registered destination floor hall call management section storing and managing provisionally assigned car registration information;

provisionally assigned car determining means determining a provisionally assigned car among said plurality of cars based on the registration contents of the registration of said hall destination floor call, and storing said provisionally assigned car registration information in said registered destination floor hall call management section;

assigned car review means extracting at least one piece of said provisionally assigned car registration information from said registered destination floor hall call management section as a review registration information set, performing assigned car review processing based on assignment evaluation indices including at least one of indices regarding waiting time until said provisionally assigned car arrives at a boarding floor and the number of stops thereof, newly determining a newly assigned car among said plurality of cars, and reregistering said newly assigned car in said registered destination floor hall call management section during a predetermined review period, said assigned car review means further executing, in a case that an estimate arrival time is within a predetermined period of time from a current time, finally assignment determined car determination processing of designating said provisionally assigned car as a finally assignment determined car; and a finally assignment determined car display section displaying, with a destination floor assigned car notification device installed in said elevator hall or in proximity thereto, correlation information of said finally assignment determined car and a destination floor covered by said finally assignment determined car.

2. The elevator group management system according to claim 1, wherein at least one of said hall destination floor registration device and said finally assignment determined car display section further has a provisionally assigned car display function of displaying said provisionally assigned car specified by said provisionally assigned car registration information.

3. The elevator group management system according to Claim 1, wherein said predetermined review period includes a period from the registration of said destination floor call to a lapse of a uniform predetermined period of time.

4. The elevator group management system according to claim 3, wherein:

said hall destination floor registration device is installed with a predetermined distance from said elevator hall; and said uniform predetermined period of time includes a period of time calculated based on an estimated period of time for walking from said destination floor registration device to said elevator hall.

5. The elevator group management system according to claim 1, wherein:

said review registration information set includes an information group in which said provisionally assigned car registration information indicating the same boarding floor, the same operation direction and the same provisionally assigned car is bundled; and said assigned car review means provides a different ID for each of said provisionally assigned car registration information and selects said provisionally assigned car registration information in ID order to perform said assigned car review processing.

6. The elevator group management system according to claim 1, wherein:

said review registration information set includes an information group in which said provisionally assigned car registration information indicating the same boarding floor, the same destination floor and the same provisionally assigned car is bundled; and said assigned car review means provides a different ID for each of said provisionally assigned car registration information and selects said provisionally assigned car registration information in ID order to perform said assigned car review processing.

7. The elevator group management system according to claim 1, wherein said finally assignment determined car display section produces a display, for each of said plurality of cars, on said destination floor assigned car notification device in a manner of displaying a destination floor in a case of the finally assignment determined car.

8. The elevator group management system according to claim 7, wherein:

said destination floor assigned car notification device includes a plurality of destination floor display devices disposed in proximity to the hall of said plurality of cars correspondingly to said plurality of cars; and each of said plurality of destination floor display devices displays a destination floor in a case where a corresponding car is the finally assignment determined car.

9. The elevator group management system according to claim 1, wherein said finally assignment determined car display section produces a display on said destination floor assigned car notification device in a manner of displaying the finally assignment determined car for each destination floor.

10. The elevator group management system according to claim 7, wherein said finally assignment determined car display section further includes a recognition-in-process destination floor display section displaying a destination floor specified by said provisionally assigned car registration information based on the provisionally assigned car registration information.

11. The elevator group management system according to claim 1, wherein said assigned car review means executes, in a case where special type passenger information is also registered with said hall destination floor registration device, said finally assignment determined car determination processing of immediately designating said provisionally assigned car assigned by said provisionally assigned car determining means as said finally assignment determined car without executing said assigned car review processing.

* * * * *